United States Patent [19]

Sawyer, Jr.

[11] 4,251,230

[45] * Feb. 17, 1981

[54] COAL SUSPENSIONS IN ORGANIC LIQUIDS

[75] Inventor: Edgar W. Sawyer, Jr., Hagerstown, Md.

[73] Assignee: International Telephone and Telegraph Corporation, New York, N.Y.

[ * ] Notice: The portion of the term of this patent subsequent to Apr. 3, 1996, has been disclaimed.

[21] Appl. No.: 955,065

[22] Filed: Oct. 26, 1978

Related U.S. Application Data

[63] Continuation-in-part of Ser. No. 810,121, Jun. 27, 1977, Pat. No. 4,147,519.

[51] Int. Cl.[3] ..... C10L 1/32

[52] U.S. Cl. ..... 44/51

[58] Field of Search ..... 44/51, 6; 106/71

[56] References Cited

U.S. PATENT DOCUMENTS

| | | | |
|---|---|---|---|
| 2,125,753 | 8/1938 | Spencer | 44/6 |
| 2,250,287 | 7/1941 | Work et al. | 44/6 |
| 3,210,168 | 10/1965 | Morway | 44/51 |

*Primary Examiner*—Winston A. Douglas
*Assistant Examiner*—Y. Harris-Smith
*Attorney, Agent, or Firm*—John T. O'Halloran; Peter C. Van Der Sluys

[57] ABSTRACT

Suspensions of coal dust powder in fuel oil are stabilized against sedimentation by an additive that makes them viscous under conditions of low shear in order to keep the coal in suspension under static conditions while exhibiting relatively low viscosity under high shear conditions to facilitate pumping through long range pipelines by the combination of a suitable surfactant with a gelling grade clay suspending agent.

34 Claims, No Drawings

COAL SUSPENSIONS IN ORGANIC LIQUIDS

CROSS-REFERENCE TO RELATED APPLICATION

This application is a continuation-in-part of copending Application Ser. No. 810,121, filed June 27, 1977, now U.S. Pat. No. 4,147,519.

BACKGROUND OF THE INVENTION

This invention relates in general to a fuel as a product, and more particularly to mobile suspensions of carbonaceous solids in combustible liquid hydrocarbons stabilized against sedimentation and process of making same.

The continually escalating cost of fuel oil as an energy source and its predicted depletion suggests the use of other type fossil fuels as fuel oil substitutes. The abundance of coal and its ready accessibility presents the need for an immediate direct substitution of coal for fuel oil wherever possible.

Several factors have retarded the immediate substitution of coal for fuel oil. One such factor is the difficulty in transporting the coal in bulk from the point of origin to the place of intended use. Another important factor to be considered in the substitution of coal for fuel oil is the effect of the coal burning by-products on the ecology. The problem of transporting coal over long distances is disclosed in U.S. Pat. No. 4,062,694. This patent provides means for forming stable suspensions of finely divided coal dust in water for efficient transport within long distance pipelines. A third factor which is of paramount importance is the necessity of converting oil burning equipment over to the proper facility for burning coal.

In order to reduce the effect of coal burning on the ecology the coal is not directly substituted for fuel oil as an energy source but rather is partially substituted for some of the fuel oil and is burned in combination with the oil. The addition of finely divided coal dust in a combustible organic liquid is shown in U.S. Pat. No. 1,390,228. This patent discloses the use of approximately 30% finely pulverized coal dust as an adjunct to fuel oil and teaches the addition of a lime-rosin grease as a means to keep the finely divided coal dust in suspension within the oil. In order to transport the coal dust-fuel oil mixture through long distance pipelines, mechanical power must be consumed in order to cause the coal dust slurry to become transported within the pipeline and must be applied at intervals to keep the coal dust slurry in motion up to the point of destination.

Although various means have been suggested to suspend finely pulverized coal dust in several grades of fuel oil, the varied and severe demands involved in storing, pumping and spraying the suspensions have heretofore made such existing suspensions commercially infeasible. Thickeners added to the fuel oil to keep the coal dust particles in suspension interfered with the flow properties of the coal dust-fuel oil mix and prevented the suspension from being transported through pipelines and being sprayed to give fine, good burning droplets in the combustion chamber.

SUMMARY OF THE INVENTION

Accordingly, an object of this invention is to provide a mobile suspension of carbonaceous solids in combustible liquid hydrocarbon stablized against sedimentation.

Another object of this invention is to provide a suspension of carbonaceous solids in combustible liquid hydrocarbon such that the solids remain in suspension without settling and clogging the pipelines over extended periods of time and further provides good flow properties to the suspension for ease in pumping and spraying.

Yet another object of this invention is to provide stable, economical coal dust-fuel oil slurries that have optimum rheological properties in order to provide stable suspensions while maintaining ease-of-pumping and ease-of-burning characteristics.

This invention provides economically feasible combustible carbonaceous solids-combustible liquid hydrocarbon suspensions that exhibit psuedoplastic flow properties. The suspensions provide good suspension stability at low shear rates and good pumpability and sprayability at higher shear rates. The addition of low concentrations of a mixture of a gelling grade clay and an organic surfactant to the carbonaceous solids liquid hydrocarbon suspension provides stable suspensions that can be stored for long periods of time without settling yet are readily pumpable over long distances without excessive power requirements or loss of stable suspending properties. Furthermore they can be pumped and sprayed through a burner nozzle with facility during the burning step, thus allowing for an easy burner conversion.

DETAILED DESCRIPTION OF THE INVENTION

In the former aforementioned U.S. Patent, coal dust suspensions in water provide long range stable suspensions which are easily pumpable over long distances. The coal dust-water suspensions with carefully controlled quantities of a gelling grade clay exhibit psuedoplastic flow. At rest the suspensions have considerable gel structure. At low shear rates the suspensions exhibit high apparent viscosities and are very stable so that when they are not being pumped, for example, as when static in the pipelines or transported in tank cars during shipment, the coal dust particles remain firmly in suspension. At higher shear rates such as those encountered during transport, mixing, pumping and spraying, the suspensions exhibited low apparent viscosities. In order to solve the problems involved with finely pulverized carbonaceous solids in liquid hydrocarbon systems it was determined that the incorporation of small quantities of a gelling grade clay plus an organic surfactant caused the carbonaceous solids liquid hydrocarbon suspensions to have psuedoplastic properties. In order to form stable, homogeneously gelled dispersions of the carbonaceous solids in the liquid hydrocarbon mixtures of gelling grade clays plus various organic surfactants were investigated to determine systems in which both the carbonaceous solids and clay can be dispersed within the liquid hydrocarbon with subsequent flocculation.

Although the invention is primarily directed to providing stable suspensions of coal dust in organic liquids for the purpose of providing an efficient combustible mixture of coal in oil that is stable and has good pumping properties, this is by way of illustration only. The invention readily finds application when other combustible solid powders are added. Other classes of carbonaceous substances, susceptible to reduction to particles by pulverization or otherwise, are suitable for combining with combustible liquid hydrocarbons according to this invention. By way of illustration but not limited thereto such carbonaceous materials comprise anthracite, semi-anthracite, bituminous and semi-bituminous coals, lignites, peats, anthracite culm, dust and slush, bituminous and lignite slack, coke, gilsonite asphalt, cannel coal and other semi-coalified materials.

This invention further readily finds application when other combustible liquids are added. In general, all liquid hydrocarbons which are useable as liquid combustible, permissible or not with others, such as oils, tars, and pitches may be used according to the method of this invention for suspension of the particles of carbonaceous substances to form the mobile fuel. By way of illustration and not limited thereto such liquid hydrocarbons include fuel oils (#2 and #6), kerosene, liquid still bottoms, pressure still oil or tar, and coal tar. By the term pressure still oil or tar is meant the residue left after topping and cracking a paraffin base oil in pressure stills. Several liquid hydrocarbons may be blended.

The suspensions according to this invention were formed by two different methods. The first method was pregelling, in which the clay and organic surfactant were first gelled at a high concentration in fuel oil and then stirred into additional fuel oil and coal to achieve the final formulation. The gelling type clay selected according to the hereinafter described examples comprise a colloidal attapulgite product manufactured by the Pennsylvania Glass Sand Corporation. By way of illustration but not limited thereto other gelling type clays may be incorporated according to this invention comprising Wyoming bentonite, sepiolite and palygorskites.

The second method of direct formulation, consisted in the addition of fuel oil, organic surfactant, gelling clay and coal dust while stirring with a high speed mixer. In all the examples tested the pregelling method resulted in higher viscosities in the final mix per given quantity of gelling clay and organic surfactant. To determine the stability of suspensions over extended periods of time, the viscosity readings were taken initially, after 24 hours, and at the end of one week. They were also stored in jars and visually examined after extended periods.

In the following examples a bituminous coal with a volatile content of 40% and an ash content of 7% was ground in a Raymond bowl mill to 88% finer than 200 mesh. Mobil's #2 fuel oil was employed as the organic liquid and MIN-U-GEL FG, a colloidal attapulgite product manufactured by the Pennsylvania Glass Sand Corporation, was used as the clay. In order to determine the rehological properties of the suspensions the viscosity was measured on a Brookfield viscometer at two different speeds. A viscometer speed of 10 RPM was taken to determine the viscosity of the suspension at low shear rates. A viscosity reading was also taken at 100 RPM as an indication of the flow properties at higher shear rates. The viscosity reading for the suspension at 10 RPM provides a good indication of the stability of the suspension against settling. The viscosity reading at 100 RPM gives an indication of ease-of-pumping and sprayability. A good indication of the desired rheological properties of the suspensions is the "Thixotropic ratio" which is defined by ratio of the viscosity reading in c.p.s. at 10 RPM to the reading at 100 RPM. The minimum 10 RPM viscosity is about 1500 c.p.s. with a minimum thixotropic ratio of about 2/1 for good flow properties without settling. The settling observation is best made visually since the gel strength and anti-caking effect of the added clay determine the degree of hard caking which can be observed when the suspensions are allowed to stand for periods of time without mixing.

PREGEL SUSPENSIONS

In the following examples 1 and 2, three pregels were formulated as follows:

| | | Wt % |
|---|---|---|
| Oil | 352 g | 88 |
| Surfactant | 8 g | 2 |
| Clay | 40 g | 10 |
| TOTAL | 400 g | 100 |

The clay concentration for the pregel was fixed at 10% by weight of the total and the ratio of the clay to the organic surfactant was fixed at 5/1. The surfactants used in the following examples for dispersing the coal and the clay are as follows:

Varine O (Northern Petrochemical Company). This surfactant is the reaction product of oleic acid and aminoethylethanolamine. It is described as an imidazoline.

Monazoline T (Mona Industries Inc.). This surfactant is the reaction product of tall oil fatty acids and aminoethylethanolamine and is also an imidazoline.

Tergitol NPX (Union Carbide Corporation). This surfactant consists of dodecylphenol condensed with 8–9 mols of ethylene oxide.

The Varine O and Monazoline T are cationic surfactants while the Tergitol NPX is a nonionic surfactant. In order to evaluate the properties of the following suspensions visual observations are indicated along with the Brookfield viscosity readings. The pregels based on the formulation given earlier are designated A, B and C according to the surfactant used in forming the pregel as follows: A=Monazoline T, B=Tergitol NPX, and C=Varine O.

EXAMPLE 1

| | Controls | | | | Run 1 | | Run 2 | |
|---|---|---|---|---|---|---|---|---|
| | 50% | | 60% | | Pregel B (60%) | | Pregel B (50%) | |
| | | Wt % | | Wt % | | Wt % | | Wt % |
| Oil* | 250 g | 50 | 200 g | 40 | 100 g | 20 | 200 g | 40 |
| Coal Dust | 250 g | 50 | 300 g | 60 | 300 g | 60 | 250 g | 50 |
| Pregel | — | — | — | — | 100 g | 20 | 50 g | 10 |
| Total | 500 g | | 500 g | | 500 g | | 500 g | |
| Clay | 0 | 0 | 0 | 0 | 10 g | 2.0 | 5 g | 1.0 |
| Surfactant | 0 | 0 | 0 | 0 | 2 g | 0.4 | 1 g | 0.2 |
| Clay/Surfactant | — | — | — | — | 5/1 | | 5/1 | |
| | Thin, | | | | Too thick | | Thin | |

-continued

| | | | | |
|---|---|---|---|---|
| | settled rapidly | | | |

*note - where pregels are used additional oil was added in the pregel. In Run 1 the total oil was 31.6%; in Run 2 it was 48.8%.

| Evaluations | | | | |
|---|---|---|---|---|
| Viscosity, cps 10/100 RPM | | | | |
| Initial | — | 4000/1080 | not run | 1000/180 |
| 24 hrs. | Heavy Sludge | Heavy Sludge | — | 940/140 No sediment 10% SN* |
| 1 week | Settled to a hard cake | Settled to a hard cake | — | 200/108 No sediment 20% SN* |

*SN = clear, supernatant liquid

Runs 1 and 2 of Example 1 indicate that the coal dust concentration of 60% with an added clay concentration of 2% resulted in a suspension that was too thick for pumping. Run 2 of Example 1 having a coal dust concentration of 50% and an added clay concentration of 1% resulted in a suspension that was quite thin and although the viscosity was low initially, it further decreased substantially after a week with the formation of as much as 20% clear supernatant liquid. The following runs were made with the three surfactants to obtain results on intermediate coal dust concentrations.

EXAMPLE 2

| | Run 3 | | Run 4 | | Run 5 | |
|---|---|---|---|---|---|---|
| | Pregel A | Wt% | Pregel B | Wt% | Pregel C | Wt% |
| Oil | 150 g | 30 | 150 g | 30 | 150 g | 30 |
| Pregel | 75 g | 15 | 75 g | 15 | 75 g | 15 |
| Coal Dust | 275 g | 55 | 275 g | 55 | 275 g | 55 |
| Total | 500 g | | 500 g | | 500 g | |
| Clay | 7.5 g | 1.5 | 7.5 g | 1.5 | 7.5 g | 1.5 |
| Surfactant | 1.5 g | 0.3 | 1.5 g | 0.3 | 1.5 g | 0.3 |
| Clay/Surfactant | 5/1 | | 5/1 | | 5/1 | |
| Brookfield Visc., cps | | | | | | |
| Initial 10/100 RPM | 7200/870 | | 12,000/1560 | | 6400/1560 | |
| 24 hrs. 10/100 RPM | 7600/900 | | 12,200/1540 No sediment | | 5000/880 | |
| | Sl. SN | | Sl. SN | | 3% SN | |
| 1 week 10/100 RPM | 8400/1010 No sed. 1% SN | | 11,700/1580 No sed. 2% SN | | 4200/800 Sl. sludge 5% SN | |

Runs 3, 4 and 5 in Example 2, having a coal dust concentration of 55% and an added clay concentration of 1.5% showed good rheological properties for all 3 pregels tested.

Direct Formulation

The following examples were prepared by directly adding the liquid hydrocarbon, coal dust, clay and surfactant without pregelling. The rheological properties were determined by determining Brookfield viscosities and visual observations as for the earlier examples.

EXAMPLE 3

| | Run 6 | Wt % | Run 7 | Wt % | Run 8 | Wt % |
|---|---|---|---|---|---|---|
| Oil | 216 g | 43.2 | 216 g | 43.2 | 172.8 g | 43.2 |

-continued

| | Run 6 | Wt % | Run 7 | Wt % | Run 8 | Wt % |
|---|---|---|---|---|---|---|
| Varine O | 1.5 g | 0.3 | — — | — | — | |
| Monazoline T | — | — | 1.5 g | 0.3 | — — | |
| Tergitol NPX | — | — | — | — | 1.2 g | 0.3 |
| Clay | 7.5 g | 1.5 | 7.5 g | 1.5 | 6.0 g | 1.5 |
| Coal Dust | 275 g | 55.0 | 275 g | 55.0 | 220 g | 55.0 |
| | 500 g | | 500 g | | 400.0 g | |
| Clay/Surfactant | 5/1 | | 5/1 | | 5/1 | |
| Brookfield Visc. cps | | | | | | |
| Initial 10/100 RPM | 600/180 Thin | | 1250/275 Thin | | 220/460 Med. viscosity | |
| 24 hrs. 10/100 RPM | 700/316 10% SN No sed. | | 800/275 5% SN No sed. | | 1060/300 5% SN No sed. | |
| 1 Week 10/100 RPM | 800/220 Sl. sludge* 20% | | 1200/305 Sl. sed.* 10% | | 1150/330 Sl. sed.* 10% SN | |

*easy to redisperse.

Example 3 indicates that the suspensions were too thin to promote good stability over the 1 week test period. This is evidenced by the occurrence of slight sludge and sediment formations in Runs 6, 7 and 8 after 1 week. It should be noted, however, that although some of the coal dust settled in a one week storage period, it was easy to redisperse and was not a hard cake.

The following examples 4 and 5 indicate the effect of variations in clay percentages, clay/surfactant ratios and percentage coal dust upon the rheological properties of the resultant suspensions.

EXAMPLE 4

| | Run 9 | | Run 10 | | Run 11 | |
|---|---|---|---|---|---|---|
| Surfactant | Monazoline T | Wt% | Monazoline T | Wt% | Tergitol NPX | Wt% |
| Oil | 212.5 g | 42.5 | 187.5 g | 37.5 | 190.6 g | 38.12 |
| Surfactant | 2.5 g | 0.5 | 2.5 g | 0.5 | 1.9 g | 0.38 |
| Clay | 10.0 g | 2.0 | 10.0 g | 2.0 | 7.5 g | 1.5 |
| Coal Dust | 275.0 g | 55.0 | 300.0 g | 60.0 | 300.0 g | 60.0 |
| | 500.0 g | | 500.0 g | | 500.0 g | |
| Clay/Surfactant | 4/1 | | 4/1 | | 4/1 | |
| Brookfield Visc., cps | | | | | | |
| Initial 10/100 RPM | 1500/360 Thin | | 10,200/2500 Thick | | 11,600/3480 Thick | |
| 24 hrs. 10/100 RPM | 1500/440 5% SN | | 12,400/2880 2% SN | | 8800/2840 2% SN | |

-continued

| | | | |
|---|---|---|---|
| | No sed. | No sed. | No sed. |

EXAMPLE 5

| | Run 12 | | Run 13 | | Run 14 | | Run 15 | |
|---|---|---|---|---|---|---|---|---|
| | Tergitol NPX | Wt% | Monazoline T | Wt% | Tergitol NPX | Wt% | Monazoline T | Wt% |
| Oil | 190 g | 38.0 | 190 g | 38.0 | 216.25 g | 43.25 | 216.25 g | 43.25 |
| Surfactant | 2.5 g | 0.5 | 2.5 g | 0.5 | 1.25 g | 0.25 | 1.25 g | 0.25 |
| Clay | 7.5 g | 1.5 | 7.5 g | 1.5 | 7.5 g | 1.5 | 7.5 g | 1.5 |
| Coal Dust | 300 g | 60.0 | 300 g | 60.0 | 275 g | 55.0 | 275 g | 55.0 |
| | 500 g | | 500 g | | 500 g | | 500 g | |
| Clay/Surfactant | 3/1 | | 3/1 | | 6/1 | | 6/1 | |
| Brookfield Visc., cps | | | | | | | | |
| Initial 10/100 RPM | 10,800/3720 Thick | | 4800/1200 Thin-med. | | 4800/920 Thin | | 2400/520 Thin | |
| 24 hrs. 10/100 RPM | 12,400/>4000 Trace SN gel | | 7600/1880 1% SN | | 2200/600 5% SN | | 1800/520 5% SN | |

According to this invention, other surfactants may be incorporated in conjunction with the gelling type clays to stabilize suspensions of the powdered coal in the combustible liquid hydrocarbons. By way of illustration, these additional organic surfactants comprise alkanolamides of carboxylic acids. The family of amines that are used to form the alkanolamides are alkanolamines, such as by way of illustration but not limited thereto, monoethanolamine (MEA), diethanolamine (DEA), monoisopropanolamine (MIA) and diisopropanolamine (DIA). The acids used for reaction with the alkanolamines by way of illustration but not limited thereto comprise fatty acids of dodecanoic acid ($C_{12}$), tridecanoic ($C_{13}$), myristic ($C_{14}$), pentadecanoic ($C_{15}$), palmitic ($C_{16}$), margaric ($C_{17}$) and stearic acid ($C_{18}$) and can include unsaturated fatty acids such as oleic and linoleic acids. The alkanolamides of carboxylic acids have the advantage of being less expensive than the surfactants described in the above examples. The alkanolamides may be prereacted or may be formed in-situ in the coal oil mixture. In-situ formation consists of adding the fatty acid plus alkanolamine to the fuel oil, heating, adding the clay with agitation followed by the addition of powdered coal also with agitation. The reactions that probably occur are:

| | | |
|---|---|---|
| $HOC_2H_4NH_2 + C_{17}H_{33}COOH$ MEA + oleic acid | → | $C_{17}H_{33}COONH_3C_2H_4OH$ oleic acid salt |
| $C_{17}H_{33}COONH_3C_2H_4OH$ oleic acid salt | heat → | $C_{17}H_{33}CONHC_2H_4OH + H_2O$ oleic acid amide + water |

Both the monoethanolamine salt of oleic acid and the monoethanolamide of oleic acid serve as dispersants for the clay and coal but only the alkanolamide forms a gel structure with the clay. This gel structure acts to suspend the dispersed coal particles and stabilize the coal-fuel oil mixture.

To facilitate the addition of alkanolamine and fatty acid the salt can be preformed as a 10% solution (or emulsion) in water. This is accomplished by adding the calculated amount of alkanolamine to water and adding the fatty acid while agitating. If the fatty acid used contains solids at room temperature, reaction rates can be increased by (1) heating the acid until it is liquid, (2) heating the water to 150°–160° F. or (3) both. Even with liquid fatty acids it is advantageous to heat the water. While stirring, the 10% solution or emulsion of salt is then added to the hot fuel oil, the clay is added, and the ground coal is added as the last addition. The excess water plus the water generated by alkanolamide formation is evolved during the processing steps. An example of a stabilized formulation is described below as Example 6.

EXAMPLE 6

A 10% solution of a monoethanolamine salt of oleic acid was made using the following mixture:

| | |
|---|---|
| Water | 90.0 g |
| MEA | 1.1 g |
| Oleic acid | 8.9 g |
| | 100.0 g |

where the ratio of MEA to oleic acid was established by determining neutralization equivalents (approx. 10 to 2.2). For this mix the water was heated to 150° F. While stirring, the MEA was added and the oleic acid was immediately added. To make a 50% coal suspension in #6 fuel oil 1% MIN-U-GEL FG (colloidal attapulgite clay) was added along with 0.25% surfactant (4/1 clay to surfactant ratio). This was accomplished by heating the #6 fuel oil to 150° F. The surfactant solution MIN-U-GEL FG and coal were added while stirring was carried out with a Waring Blender and the final mix temperature was 190° F.

The formulation used was:

| | | | |
|---|---|---|---|
| Fuel oil #6 | 487.5 | g | |
| Surfactant Solution | 25 | g | (22.5 g of Water) |
| MIN-U-GEL FG | 10 | g | |
| 200 Mesh Bituminous Coal | 500 | g | |
| Total non-volatile | 1000 | g | |
| Evaluation results on this mix were: | | | |
| Initial Results | | | |
| Brookfield Visc., cps | | | |
| 10 RPM/100 RPM | | | 2600/1960 |
| Stored 24 hrs. at 160° F. | | | |
| Visc. 10/100 RPM | | | 3400/2500 |
| Condition | | | No sediment |
| Stored 1 Week at 160° F. | | | |
| Visc. 10/100 RPM | | | 3600/2720 |

-continued

| | |
|---|---|
| Condition | No sediment |
| Stored 2 Weeks at 160° F. | |
| Visc. 10/100 RPM | 4600/3520 |
| Condition | No sediment |
| Stored 1 Month at 160° F. | 4000/3550 |
| Condition | No sediment |

Other formulations for the use of oleic acid monoethanolamide/clay gels stabilizing 50% coal oil mixtures in which clay percentage and clay/surfactant ratios were varied are illustrated in examples 7 to 19 and Controls are illustrated in Examples 20 to 22.

| | 1% Clay | | | |
|---|---|---|---|---|
| Example | 7 | 8 | 9 | 10 |
| Clay/Surfactant | 3/1 | 4/1 | 5/1 | 6/1 |
| Initial Viscosity | | | | |
| 10/100 RPM | 3600/2320 | 2600/1960 | 2000/1280 | 2000/1420 |
| 1 Week Viscosity | | | | |
| 10/100 RPM | 4200/3200 | 3600/3520 | 2800/2340 | 3000/2520 |
| Settling | none | none | none | none |
| Thixotropic Ratio | 1.31 | 1.03 | 1.20 | 1.19 |

| | 0.75% Clay | | | | |
|---|---|---|---|---|---|
| Example | 11 | 12 | 13 | 14 | 15 |
| Clay/Surfactant | 3/1 | 4/1 | 5/1 | 6/1 | 7/1 |
| Initial Viscosity | | | | | |
| 10/100 RPM | 2200/1920 | 2000/1440 | 1800/1280 | 1600/1380 | 2000/1720 |
| 1 Week Viscosity | | | | | |
| 10/100 RPM | 2800/2000 | 2200/1800 | 2000/1720 | 2000/1680 | 2000/1800 |
| Settling | none | none | none | slight | slight |
| Thixotropic Ratio | 1.4 | 1.22 | 1.16 | 1.19 | 1.11 |

| | 0.50% Clay | | | |
|---|---|---|---|---|
| Example | 16 | 17 | 18 | 19 |
| Clay/Surfactant | 3/1 | 4/1 | 5/1 | 6/1 |
| Initial Viscosity | | | | |
| 10/100 RPM | 2000/1720 | 2000/1520 | 1800/1560 | 1600/1420 |
| 1 Week Viscosity | | | | |
| 10/100 RPM | 2000/1660 | 1800/1640 | 1800/1640 | 1600/1480 |
| Settling | none | none | none | heavy |
| Thixotropic Ratio | 1.20 | 1.10 | 1.10 | 1.08 |

| | Controls | | |
|---|---|---|---|
| Example | 20 | 21 | 22 |
| | No clay No surfactant | No clay 0.25% surfactant | No clay No surfactant |
| Initial Viscosity | | | |
| 10/100 RPM | 1100/930 | 1700/1240 | 1200/1090 |
| 24 hr. viscosity | | | |
| 10/100 RPM | 2100/1740 | 2400/1880 | 2200/1990 |
| Settling | heavy | gummy | thick |
| 3 days viscosity | | | |
| 10/100 RPM | 2100/1800 | 2500/2000 | 2100/1810 |
| Settling | heavy | very thick | thick |
| 1 week viscosity | | | |
| 10/100 RPM | 2300/1710 | 2800/2450 | 2400/2150 |
| Settling | heavy | very thick | thick |

The ten percent water solutions of oleic acid salts of diethanolamine, monoisopropanolamine and diisopropanolamine can be made up in the same manner as described in Example 6 for MEA plus oleic acid and used to obtain similar results.

As described above the ratio of alkanolamine to fatty acid is established by determining neutralization equivalents. Other fatty acids as described above, having from 12 to 18 carbon atoms and including unsaturated fatty acids such as linoleic acid may be substituted for oleic acid as described in example 6 and obtain similar results as described in the above examples. It is apparent to one skilled in the art that a plurality of combinations of fatty acids and alkanolamines described above may be incorporated in the method of the present invention, it only being required that the ratio of alkanolamines to fatty acid be established by determining neutralization equivalents.

Coal dust-fuel oil slurries having good rheological properties over extended periods of time can be attained by the proper selection of total solids, amount of clay, type of surfactant and clay/surfactant ratio. The pregelling method in which the clay and surfactant were gelled at a high concentration in oil and then stirred into additional oil and coal provided higher viscosities in the final mix for the same quantity of coal and surfactant than when the clay and surfactant were added directly to the coal and oil without pregelling. The high viscosities measured at low shear rates for the examples tested proved that stable suspensions of coal dust in fuel oil over long periods of time can be achieved. The relatively low viscosities of the coal dust-fuel oil suspensions of this invention at higher shear rates are a good indication that the same suspensions can be readily pumped and sprayed under the higher shear conditions encountered in these operations.

The use of coal dust suspensions in the range of 50 to 60% by weight is based upon idealized conditions for combustion. Since the BTU output for commercial grade fuel oil is roughly double that for the equivalent weight of coal a 50% addition by weight of coal dust would result in approximately 75% of the BTU output for an equivalent weight of fuel oil alone. Since the coal dust-fuel oil suspension produces a flame having properties between that of fuel oil or coal alone the resulting flame properties can readily be controlled by varying the concentration of coal dust in the coal dust-oil suspension. In order for the suspension to be efficient enough for most commercial burner applications, ranges in coal dust from 35 to 70% should be employed with corresponding ranges in the fuel oil of from 56 to 28% by weight. In order to provide efficient long term stable suspensions of the coal dust in the fuel oil, the quantity of surfactant employed must be correspondingly adjusted along with the proper quantity of clay. For coal dust ranges of 35 to 70% the clay concentration should vary from 0.5 to 3.0% by weight depending upon the amount of coal suspended. The surfactant concentration depending upon the amount of coal dust within the 35 to 70 weight percent range can vary from 1.0 down to as little as 0.1 percent by weight. The ratio of clay to surfactant for all the suggested ranges should be from 3-1 to 7-1 depending upon the quantity of coal dust to be suspended within any given range and the amount of naturally-occurring clay in the coal dust. It is realized that adjustments in clay usage and clay to surfactant ratio may be necessary when other carbonaceous solids and combustible liquid hydrocarbons other than those illustrated in the above examples are used according to this invention.

I claim:

1. A mobile combustible suspension comprising:
carbonaceous solids in particulate form;
a combustible liquid hydrocarbon for dispersion of said solids;
a gelling grade clay to cause the combustible liquid hydrocarbon to become gelled; and
an alkanolamide of a carboxylic acid as a surfactant for dispersing the solids and clay within the suspension whereby the mobile suspension has a relatively high apparent viscosity at low shear and a relatively low apparent viscosity at high shear.

2. The suspension as set forth in claim 1 wherein the alkanolamide of a carboxylic acid is formed from the reaction between an alkanolamine and a fatty acid.

3. The suspension as set forth in claim 2 wherein the alkanolamine is selected from the group consisting of monoethanolamine, diethanolamine, monoisopropanolamine and diisopropanolamine.

4. The suspension as set forth in claim 2 wherein the fatty acid is selected from a group consisting of dodecanoic acid, tridecanoic acid, myristic acid, pentadecanoic acid, palmitic acid, margaric acid, oleic acid and linoleic acid.

5. The suspension as set forth in claim 1 wherein the liquid hydrocarbon is selected from the group consisting of fuel oil, mineral spirits, kerosene, coal tar, and pressure still oil or tar, or mixtures thereof.

6. The suspension as set forth in claim 1 wherein the carbonaceous solids are selected from the group consisting of coke, coal and asphalt.

7. The suspension as set forth in claim 6 wherein the coal is selected from the group consisting of lignite, bituminous, anthracite and cannel coal or mixtures thereof.

8. The suspension as set forth in claim 7 wherein the coal comprises a coal dust powder having a particle size between 100 and 200 mesh.

9. The suspension as set forth in claim 7 wherein the coal contains a volatile content of about 40% and an ash content of about 7%.

10. The suspension as set forth in claim 8 wherein the coal dust is about 88% finer than about 200 mesh.

11. The suspension as set forth in claim 1 wherein the clay is selected from the group consisting of attapulgite, Wyoming bentonite, sepiolite and palygorskite or mixtures thereof.

12. A suspension of carbonaceous solids in a combustible liquid hydrocarbon having a relatively high apparent viscosity at low shear and a relatively low apparent viscosity at high shear comprising:
from about 25–70% by-weight of carbonaceous solids in particulate form;
from about 28–56% by-weight of combustible liquid hydrocarbon;
from about 0.5–3.0 weight percent of a gellint grade clay to cause the liquid hydrocarbon to become gelled; and
from about 0.1–1.0 weight percent of an alkanolamide of a carboxylic acid as a surfactant of the type that will disperse the clay in the liquid and will not prevent the refloculation and formulation of a gel structure of the clay particles in the liquid, whereby the surfactant disperses the carbonaceous solids and the clay within the suspension.

13. The suspension as set forth in claim 12 wherein the alkanolamide of a carboxylic acid is formed from the reaction between an alkanolamine and a fatty acid.

14. The suspension as set forth in claim 13 wherein the alkanolamine is selected from the group consisting of monoethanolamine, diethanolamine, monoisopropanolamine and diisopropanolamine.

15. The suspension as set forth in claim 13 wherein the fatty acid is selected from a group consisting of dodecanoic acid, tridecanoic acid, myristic acid, pentadecanoic acid, palmitic acid, margaric acid, oleic acid and linoleic acid.

16. A powdered coal suspension in fuel oil having a high apparent viscosity at low shear and a low apparent viscosity at high shear comprising:
from about 50–60% by-weight of powdered coal;
from about 38–49 weight percent of fuel oil;
from about 0.5–1.0 weight percent gelling grade clay for causing the fuel oil to become gelled; and
from about 0.1–0.33 weight percent of an alkanolamide of a carboxylic acid as a surfactant of the type that will disperse the clay in the liquid and will not prevent the refloculation and formulation of a gel structure of the clay particles in the liquid, whereby the surfactant disperses the carbonaceous solids and the clay within the suspension.

17. A method of forming a mobile combustible suspension of carbonaceous solids in a combustible liquid hydrocarbon having a high apparent viscosity at low shear and a low apparent viscosity at high shear comprising the steps of:
forming an alkanolamide by reacting an alkanolamine with a carboxylic acid; and adding the alkanolamide, a gelling grade clay and the carbonaceous solids to the liquid hydrocarbon to form the mobile suspension.

18. A method of forming a mobile combustible suspension of carbonaceous solids in a combustible liquid hydrocarbon having a high apparent viscosity at low shear and a low apparent viscosity at high shear comprising the steps of:

reacting an alkanolamine with a carboxylic acid in the liquid hydrocarbon to form an alkanolamide;

adding a gelling grade clay to the liquid hydrocarbon; and adding the carbonaceous solids to the liquid hydrocarbon to form the mobile suspension.

19. The method of claim 17 or 18 wherein the alkanolamine is selected from the group consisting of monoethanolamine, diethanolamine, monoisopropanolamine and diisopropanolamine.

20. The method of claim 17 or 18 wherein the carboxylic acid is selected from the group consisting of dodecanoic acid, tridecanoic acid, myristic acid, pentadecanoic , palmitic acid, margaric acid, stearic, oleic acid and linoleic acid.

21. The method of claim 17 or 18 wherein the carbonaceous solids are selected from the group consisting coke, coal, asphalt and mixtures thereof.

22. The method of claim 17 or 18 wherein the liquid hydrocarbon is selected from the group consisting of fuel oils, kerosene, coal tar, pressure still bottoms and mixtures thereof.

23. The method of claim 17 or 18 wherein the carbonaceous solids are in the range of about from 35–70% by-weight.

24. The method of claim 17 or 18 wherein the carbonaceous solids are in the range of about from 50–60% by-weight.

25. The method of claim 17 or 18 wherein the liquid hydrocarbon is in the range of about from 28–56% by-weight.

26. The method of claim 17 or 18 wherein the liquid hydrocarbon is in the range of about from 38–49% by-weight.

27. The method as set forth in claim 17 or 18 wherein the clay is in the range of about from 0.5–3.0% by-weight.

28. The method of claim 17 or 18 wherein the clay is in the range of about from 0.1–1.0% by-weight.

29. The method of claim 17 or 18 wherein the clay is in the range of about from 0.5–3.0% by-weight and the ratio of clay to alkanolamide is in the range of about 3/1 to 7/1.

30. The method as set forth in claim 17 or 18 wherein the clay is in the range of about from 0.5–3.0% by-weight and the ratio of clay to alkanolamide is in the range of about from 4/1 to 5/1.

31. The method as set forth in claim 17 or 18 wherein the clay is selected from the group consisting of attapulgite, Wyoming bentonite, sepiolite and palygorskite and mixtures thereof.

32. The method as set forth in claim 17 or 18 wherein the carbonaceous solids contain a volatile content of about 40% and ash content of about 7%.

33. The method as set forth in claim 17 or 18 wherein the clay is in the range of from about 0.1–1.0% by-weight and the ratio of clay to alkanolamide is in the range of about 3/1 to 7/1.

34. The method of claim 17 or 18 wherein the clay is in the range of about from 0.1–1.0% by-weight and the ratio of clay to alkanolamide is in the range of about from 4/1 to 5/1.

* * * * *